US005846325A

United States Patent [19]

Crabtree et al.

[11] Patent Number: 5,846,325

[45] Date of Patent: Dec. 8, 1998

[54] COATING BLADE AND METHOD OF USING THE SAME

[75] Inventors: Richard Sidney Crabtree, Waverly; Gary Paul Fugitt, Chillicothe, both of Ohio

[73] Assignee: The Mead Corporation, Dayton, Ohio

[21] Appl. No.: 804,654

[22] Filed: Feb. 25, 1997

[51] Int. Cl.[6] ..... B05C 1/00

[52] U.S. Cl. ..... 118/123; 118/126; 118/413; 162/281; 162/265

[58] Field of Search ..... 118/123, 126, 118/413; 162/281, 265; 427/356

[56] References Cited

U.S. PATENT DOCUMENTS

| | | | |
|---|---|---|---|
| 3,356,067 | 12/1967 | Krasnow et al. | 118/123 |
| 4,076,865 | 2/1978 | Wallsten | 427/209 |
| 4,241,691 | 12/1980 | Hopfe et al. | 118/126 |
| 4,469,434 | 9/1984 | Yamazaki et al. | 355/15 |
| 4,780,336 | 10/1988 | Damrou | 427/356 |
| 4,812,878 | 3/1989 | Kaieda | 355/15 |
| 4,859,507 | 8/1989 | Damrou | 427/356 |
| 4,895,071 | 1/1990 | Benton | 101/169 |
| 4,964,364 | 10/1990 | Karna et al. | 118/410 |
| 5,076,200 | 12/1991 | Mayer et al. | 118/126 |
| 5,119,755 | 6/1992 | Beisswanger | 118/123 |
| 5,197,587 | 3/1993 | Malmberg | 198/497 |
| 5,224,995 | 7/1993 | Shibamoto | 118/249 |
| 5,520,731 | 5/1996 | Esser et al. | 118/126 |

FOREIGN PATENT DOCUMENTS

| | | |
|---|---|---|
| 470188 | 1/1929 | Germany . |
| 2637828 | 3/1977 | Germany . |
| 4033481 | 4/1992 | Germany . |
| 39752 | 12/1915 | Sweden . |

*Primary Examiner*—Laura Edwards
*Attorney, Agent, or Firm*—Thompson Hine & Flory LLP

[57] ABSTRACT

The invention is a coating blade for coating a paper web and a method of using the same. The coating blade includes a notch in its thickness on the tension side of the blade toward the coating end, above the fulcrum such that it has the advantages of both thick and thin coating blades.

5 Claims, 2 Drawing Sheets

COATING BLADE AND METHOD OF USING THE SAME

BACKGROUND OF THE INVENTION

The present invention relates to coating blades for coating substrates; and more particularly, this invention relates to coating blades which alter blade loadings and improve runability during the coating of a paper web substrate.

In order to convert uncoated paper basestock into a coated product the following four steps are generally followed: application of the coating to the basestock, metering or measuring the proper amount of coating, smoothing the coating in a wet state and smoothing the coating in a dry state, often called calendaring. Some processes combine several of these steps in one operation. The blade coating technique of coating uses a trough of coating material and a blade to transfer the material to the paper as it passes on a backing roll. Metering and wet state smoothing are accomplished by the constant pressure of the blade against the paper and the backing roll. Blade coating is advantageous because it results in smooth surfaces as the nature of the blade fills depressions and applies less coating on the high spots.

The blade may have a beveled metering surface at its coating end which is pressed against the backing roll. The coat weight of the coating is determined by the equilibrium between the force on the coating face and the hydrodynamic counterforce of the coating composition. This is changed due to fluctuations in web speed, and properties of the paper, coating composition, etc. One problem with the method is that grooves can be formed in the coated paper which are caused by solid particles sticking under the blade. "Grit lines" are a disturbance of the coating layer caused by debris which gets trapped between the coating blade and the substrate. The debris can be caused by nylon and cellulose fibers in the paper surface, dried coating particles, metal from the mill water, air and raw materials or calcite and quartz or other particulate from the coating pigments.

The coating blade is "loaded" by applying pressure to the coating blade. Conventional coating blades require low blade loadings, particularly on smooth substrates. However, it is not always desirable to have low blade loadings. Therefore, this is usually compensated for through the use of "thinner" or less rigid coating blades. However, the use of thin blades is disadvantageous as it results in poor coat weight profiles and the resultant coated sheets show defects such as grit lines. Therefore, it is desirable to be able to keep the thicker blades to remove the grit lines and have the thinner blades for proper blade loading.

German Patent No. DE 40 33 481 A1 to Esser et al. teaches coating blades having cross-sections which have two or more variations in thickness. It teaches step-wise "jumps" which are parallel to the metering side of the blade. However, the cross-sectional deviations are on the metering face of the blade. Further, the minimum thickness of the blade, even in the narrowed cross-sectional areas is 0.25 mm.

U.S. Pat. No. 3,356,067 to Krasnow teaches a doctor blade having bevelled ends and notches in their end portions. However, the notch 18 of Krasnow does not extend completely along the length of the blade. The area where the web is located is not notched.

Accordingly, there is a need for an improved coating blade which improves runability, reduces grit lines and increases the range of loadings which are usable with the blade. Further, there is a need for a blade which is capable of achieving the advantages of both thick and thin blades, to produce fewer coating defects on the coated substrate.

SUMMARY OF THE INVENTION

The present invention is a coating blade for use in coating a substrate such as paper and a method therefor which improves runability. Blade geometry has been found to have an important impact on reduction of grit line formation. Thicker blades produced fewer grit lines than thinner blades. However, thicker blades require lower loadings than thinner blades and those lower loadings may be outside of the loading range allowed for a given coater head. In accordance with the invention, the benefits of a thicker blade in terms of reducing grit lines and a thinner blade in terms of higher blade loadings are achieved. The blade includes a notch which extends the length of the tension side of the blade positioned toward the coating end thereof just above the loading fulcrum.

In a preferred embodiment of the invention, the coating blade comprises a coating end being shaped to coat a substrate; a clamping end at a second end thereof opposite said coating end, for attaching the blade to a clamp; the blade having a tension side and a compression side; wherein the blade includes a notch along the compression side of the blade, and the notch extending the length of the blade and being located toward the coating end of the blade above the loading fulcrum.

The invention also includes a method of coating a paper web comprising the steps of: providing a backing roll for supporting the paper web during coating; rotating the backing roll to transport the web; providing a coating; applying a coating to the web with a coating blade and applying pressure from the loading fulcrum to the blade wherein the coating blade has an upstream or tension side facing the web and a downstream, compression side substantially parallel to the tension side, such that the coating blade has a thickness-reducing notch in the upstream face which extends the length of the blade.

Other objects and advantages of the present invention will be apparent from the following description, the accompanying drawings and the appended claims.

DETAILED DESCRIPTION

Figure 1:
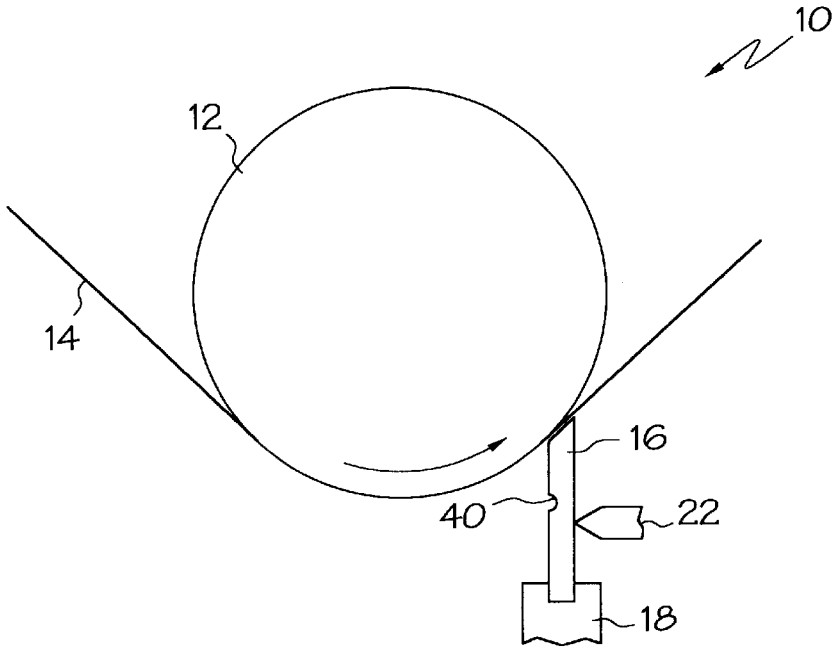
FIG. 1 is a schematic view of the coating apparatus of the present invention.

As shown in FIG. 1, a coating apparatus generally designated 10 in accordance with the present invention includes a backing roll 12 which supports a portion of paper web 14 during coating. The apparatus 10 also includes a coating blade 16 which is held in place by a clamp 18. A loading fulcrum 22 is provided to apply pressure to the blade 16 during the coating operation.

Figure 2:
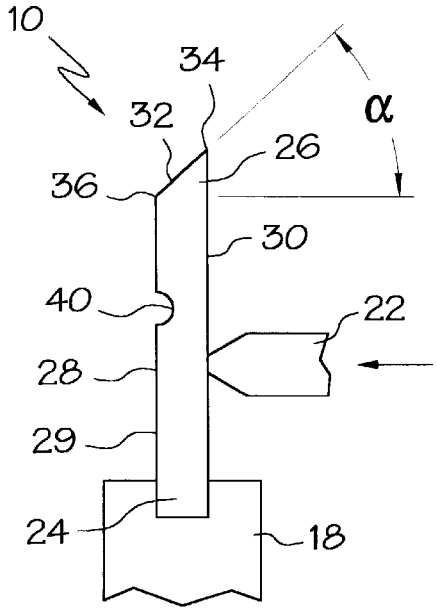
FIG. 2 is a cross-sectional side view of the coating blade of FIG. 1.
Figure 3:
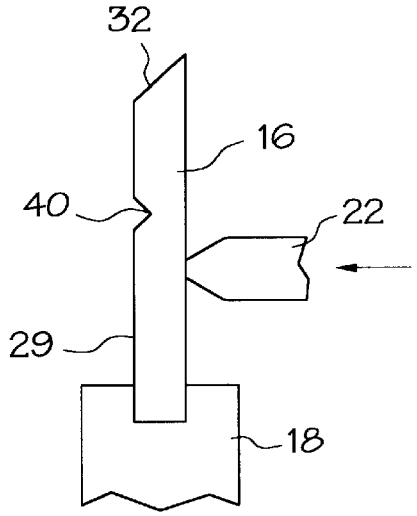
FIG. 3 is an alternative coating blade profile.
Figure 4:
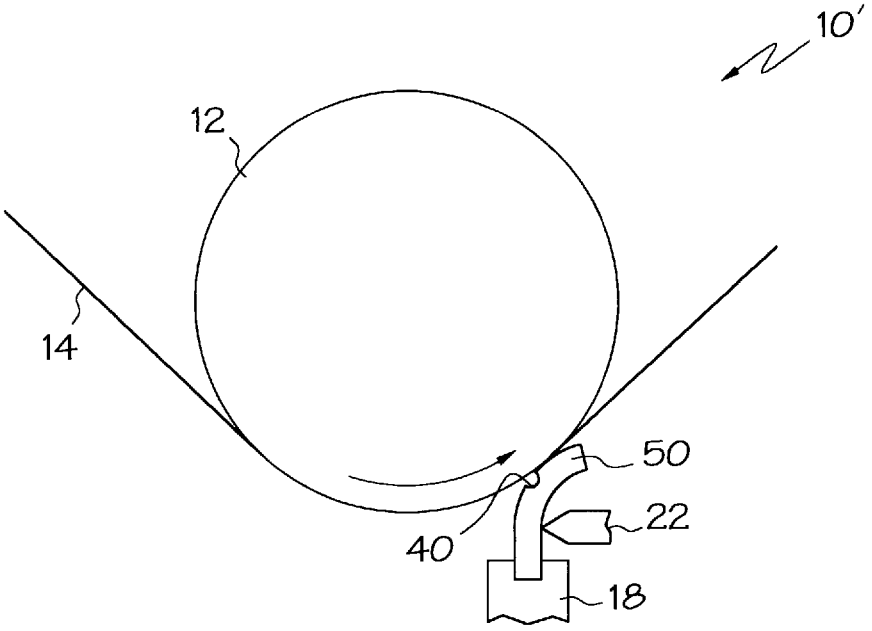
FIG. 4 is a schematic view of an alternative coating apparatus of the present invention showing a flexible blade.
Figure 5:
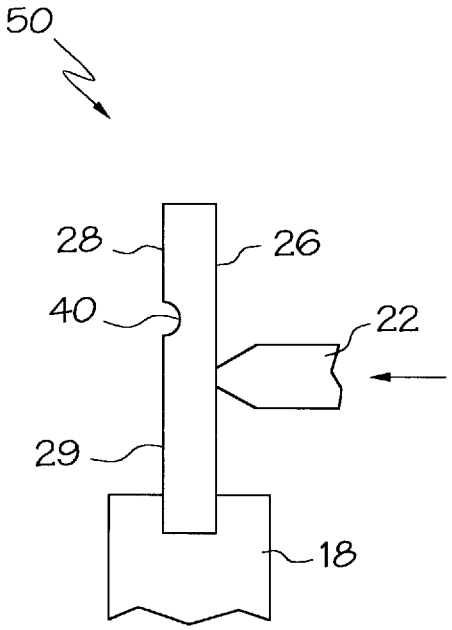
FIG. 5 is a cross-sectional side view of the coating blade of FIG. 4.

The backing roll 12 rotates in the direction shown by the arrow. The coating is transferred to the paper web 14 via the coating blade 16 as the web traverses the backing roll 12. As shown in FIG. 2, the coating blade 16 has a lower clamping end 24 which is mounted in a holder with a clamp 18 and an upper coating end 26 which contacts the paper web 14 under pressure. There are two types of coating blades. One type is shown in FIG. 1–3 and includes a beveled end 32. The beveled surface 32 is the coating surface which acts on the coating. In another embodiment as shown in FIGS. 4–5, the coating surface is on the side 29 of the coating blade, known as the tension side. The blade 16 includes a coating surface 28 on the tension side 29 of the blade and a compression side 30 on which the fulcrum 22 acts. The thickness of the blade may vary from about 0.012 to 0.025 inches, depending on the coating being applied and the requirements of a given coating head.

In a first embodiment shown in FIGS. 1–3, the coating surface is beveled 32 in its thickness from said upstream 28 face to said downstream 30 side. The bevel angle $\alpha$ is determined by the size of the backing roll 12 and type of coating and paper used and is typically about 20° to 50°. The bevel 32 includes a toe portion 34 which is located adjacent to the compression side 30 of the blade as shown in FIG. 1 and a heel portion 36 which is located adjacent the upstream side 29. To reduce the occurrence of grit lines, it has been found desirable to have the bevel surface 32 parallel to the substrate or tilted slightly towards the toe 34.

The bevel angle $\alpha$ and bevel area vary with backing roll size. Thicker blades, e.g. 0.025 inch or blades which correspondingly have larger bevel areas run cleaner with fewer grit lines. The bevel angle is usually selected so that the bevel surface runs tangent to the roll surface at the point of contact with the blade.

The blade 16 is preferably formed of a metal such as steel, although those of skill in the art can imagine the blade may be made of other suitable materials.

Figure 6:
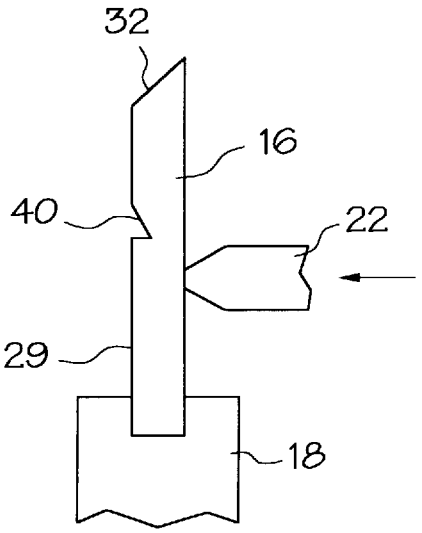
FIG. 6 is a further alternative coating blade profile.

The coating blade 16 of the present invention includes a notch 40 or groove on the tension side 29 between the coating end 26 and the clamping end 24 above the loading fulcrum 22. Preferably, the notch 40 is a groove which extends the width (cross machine direction) of the coating blade. The notch can be made by grinding or by another suitable technique. The notch may have a rounded u-shaped cross-section as shown in FIG. 2 or an angled (v-shaped) cross-section as shown in FIG. 3. In addition a tapered v-shaped notch may be used as shown in FIG. 6. The thickness of the blade is substantially uniform except in the area of the notch where it is thinner.

With the coating blades of the present invention greater flexibility in selecting coating parameters is available. There is a desirable coating range for any given coater at which the coater will run well. (i.e. for good runability and clean coatings the viscosity, coat weight, loading, and coating speed must be within a narrow limit). By using the coating blade of the present invention, this coating range is increased and a wider variety of viscosities, loadings and speeds may be used for the same coater and still have good runability. A medium to medium-high loading is preferred. Loading is an arbitrary number such as mm of deflection, angular change, or it could be a random number readout. For example, a lower coating viscosity e.g. 1500 to 4000 cps can be used which will increase flexibility in the coating range and allow the coating operation to run faster and the coating to dry faster, and the blade loading can be kept the same. Further, known additives may be added to the coating to make it run smoother. For example, utilizing the notch shown in FIG. 6, the same loading force can be applied to a 0.025 inch thickness blade having a notch ground to 0.012 inch thickness that is applied to a 0.015 inch thick blade of constant thickness.

In an alternative embodiment shown in FIGS. 4 and 5, the coating surface 28 is on the tension side 29 of the blade 50. In this instance, the blade bends toward the loading fulcrum 22 during the coating process. Since the coating surface 28 is on the tension side 29 of the blade it is not necessary to bevel the end of the blade. The notch 40, similar to that shown in FIGS. 1–3 extends the width of the blade.

The method of using the coating blade will now be described with respect to the above-described coating blade. A paper web 14 is fed through a coating apparatus 10. It is supported on a backing roll 12 which is rotated in order to transport the web. The coating is applied to the paper web by means of the coating blade 16. The clamping end 24 of the coating blade is held stationary in the clamp 18. The heel 36 of the bevelled edge in FIG. 1 or the coating surface in FIG. 2 abuts the web and meters the coating as it is being applied. Because of the notch 40, the blade has both a thick and a narrowed thickness and therefore, the coating blade utilizes the advantages of both. It reduces the grit lines and allows flexibility in the loading which can be applied.

EXAMPLE substantially rectangular coating blade 286.42 inches long, 3.5 inches wide and 0.025 inches thick is made of rigid steel. The coating blade has a bevel of 35° from said upstream to said downstream. The notch is rounded and is located ⅞ inches from the top of the blade. Further, the notch is ground to 0.012 inches. The coating applied was 45% fine clay, 35% fine ground calcium carbonate, 5% titanium dioxide, 13% latex and other known additives such as calcium stearate, cross linkers and binders. The line speed was 3000 fpm, the loading was in the 20s and the coat rate was 8.0 lbs/ream or 10–12 g/m$^2$. This produced 25–75% fewer grit lines as compared to a similar blade without the notch.

Having described the invention in detail and by reference to preferred embodiments thereof, it will be apparent that modifications and variations are possible without departing from the scope of the invention defined in the appended claims.

What is claimed is:

1. A coating blade comprising:

a coating end at one end of said blade;

a coating surface at the coating end of said blade;

a clamping end at the end of said blade opposite said coating end, for attaching said blade in a blade clamp;

a compression side and a tension side running the length of said blade;

a fulcrum about which said blade bends during coating;

wherein said blade includes a notch in its thickness between said coating end and said clamping end on said tension side of said blade, said notch being located toward said coating end of said blade above said fulcrum and running the entire length of said blade, parallel to the coating surface, said blade being at least 0.025 inch thick.

2. The coating blade of claim 1 wherein said coating end is beveled.

3. The coating blade of claim 1 wherein said notch has an accurate cross-section.

4. The coating blade of claim 1 wherein said notch has an angular cross-section.

5. A coating assembly comprising a coating blade, a clamp and a coating roll wherein a coating composition is applied to a substrate as said substrate passes between said coating roll and said blade, said coating blade having a coating end at one end of said blade;

a coating surface at the coating end of said blade;

a clamping end at the end of said blade opposite said coating end, for attaching said blade in a blade clamp;

a compression side and a tension side running the length of said blade;

wherein said blade includes a notch in its thickness between said coating end and said clamping end on said tension side of said blade, said notch being located toward said coating end of said blade above said fulcrum and running parallel to the coating surface said blade being at least 0.025 inch thick.

* * * * *